US005711416A

United States Patent [19]

Bauman

[11] Patent Number: 5,711,416

[45] Date of Patent: Jan. 27, 1998

[54] DISPOSABLE CONTACT LENS STORAGE CONTAINER WITH CONCAVE STORAGE RECESS

[76] Inventor: Robert C. Bauman, 232 Goodhouse Rd., Litchfield, Conn. 06759

[21] Appl. No.: 260,088

[22] Filed: Jun. 15, 1994

[51] Int. Cl.[6] ..... B65D 81/24

[52] U.S. Cl. ..... 206/5.1; 206/210

[58] Field of Search ..... 206/5.1, 210

[56] References Cited

U.S. PATENT DOCUMENTS

| | | | |
|---|---|---|---|
| D. 210,248 | 2/1968 | Nissel | 206/5.1 X |
| 3,186,540 | 6/1965 | Breger | 206/5.1 X |
| 3,268,068 | 8/1966 | LeGrand | 206/5.1 X |
| 3,977,517 | 8/1976 | Kadlecik et al. . | |
| 3,990,579 | 11/1976 | Manning . | |
| 4,091,917 | 5/1978 | Clawson et al. . | |
| 4,332,318 | 6/1982 | Feldman . | |
| 4,392,569 | 7/1983 | Shoup . | |
| 4,508,216 | 4/1985 | Kelman . | |
| 4,545,478 | 10/1985 | Waldman . | |
| 4,691,820 | 9/1987 | Martinez | 206/5.1 X |
| 4,897,981 | 2/1990 | Beck | 206/5.1 X |
| 4,981,657 | 1/1991 | Ryder . | |
| 5,054,610 | 10/1991 | Ajello | 206/5.1 |
| 5,199,559 | 4/1993 | Dark | 206/5.1 |

*Primary Examiner*—Ted Kavanaugh
*Attorney, Agent, or Firm*—Pepe & Hazard

[57] ABSTRACT

A lens storage container includes an integrally formed receptacle member having a bottom wall and a sidewall providing a cavity. A concave recess is provided on the upper surface of the bottom wall and it is dimensioned and configured to seat a contact lens therein. A closure extends across the cavity and is secured to the sidewall of the receptacle member.

5 Claims, 3 Drawing Sheets

DISPOSABLE CONTACT LENS STORAGE CONTAINER WITH CONCAVE STORAGE RECESS

BACKGROUND OF THE INVENTION

The present invention relates to contact lens storage containers, and, more particularly, to disposable storage containers for contact lenses.

Many different types of containers have been used for storage of contact lenses. Some of these are relatively durable molded structures intended for repeated use and include replaceable covers. Others are relatively low cost disposable structures for storage of the lens prior to use by the wearer. Recently, the increasing use of disposable contact lens has resulted in efforts to produce lower cost containers.

All such storage containers must be relatively free from leakage of liquid and vapor to ensure that the lens will be immersed in the liquid within the container or exposed to a highly moist atmosphere so that the lens retains its high moisture content. Typical disposable lens containers have a molded receptacle and a foil cover which can be peeled therefrom.

Some permanent lens storage containers have employed complex structures for seating the lens at a specific position within the container. Illustrative of such containers are Ryder U.S. Pat. No. 4,981,657 which has a hanger with spheric surfaces to seat the contact lens and Kadlecik et al U.S. Pat. No. 3,977,517. Manning U. S. Pat. No. 5,990,579 provides a container with a base providing a convex surface and a cap with a concave surface to locate the lens therebetween. Shoup U.S. Pat. No. 4,392,569 employs a similar combination of convex/concave opposed surfaces. Waldman U.S. Pat. No. 4,545,478 positions the lens on a hanger molded on the cap between opposed concave/convex surfaces. Clawson et al U.S. Pat. No. 4,091,917 provides a concave surface on the cover to which the lens will adhere.

As can be seen, these are all relatively complex structures which are relatively expensive to fabricate.

It is an object of the present invention to provide a novel disposable contact lens storage container for locating the lens and enabling its convenient removal from the container.

It is also an object to provide such a container which limits the potential for damaging the lens during removal.

A further object is to provide such a container which may be fabricated readily and economically.

SUMMARY OF THE INVENTION

It has now been found that the foregoing and related objects may be readily attained in a contact lens storage container comprising an integrally formed receptacle member having a bottom wall with upper and lower surfaces and a sidewall extending upwardly from the periphery of the bottom wall and cooperating therewith to provide a cavity opening at the upper end of the sidewall. The bottom wall provides a concavely curved recess on the upper surface thereof which is configured and dimensioned to seat a contact lens therein. A closure extends across the cavity and is secured to the upper end of the sidewall of the receptacle member.

In one embodiment, the receptacle member is elongated and the bottom wall slopes downwardly from one end in the axis of elongation to a sidewall of increased height at the other end, and the recess is disposed in the bottom wall adjacent the other end.

In another embodiment, the receptacle is of generally rectangular configuration and the bottom wall has upwardly extending portions adjacent opposite ends thereof to provide feet at the opposite ends for stable seating the container on a support surface. The bottom wall is inclined downwardly from the upwardly inclined portions to the recess which is disposed intermediate the upwardly inclined portions.

In still another embodiment, the bottom wall extends upwardly from the plane of its juncture with the sidewall to provide a pedestal portion in which the recess is disposed. Preferably, the receptacle member is elongated and the pedestal portion is spaced from the sidewall at the ends of the elongated axis, and the bottom wall outwardly of the pedestal lies in a common plane. The juncture of the pedestal portion and the portion of the bottom wall thereabout is generally concavely arcuate.

Desirably, the receptacle member has an outwardly extending flange at the upper end of the sidewall to which the closure is releasably engaged, and the receptacle member is generally rectangular. The radius of curvature of the concave recess is about 5.7 to 11.7 millimeters, and the receptacle member is integrally molded of synthetic resin.

DETAILED DESCRIPTION OF THE PREFERRED EMBODIMENTS

Figure 1:
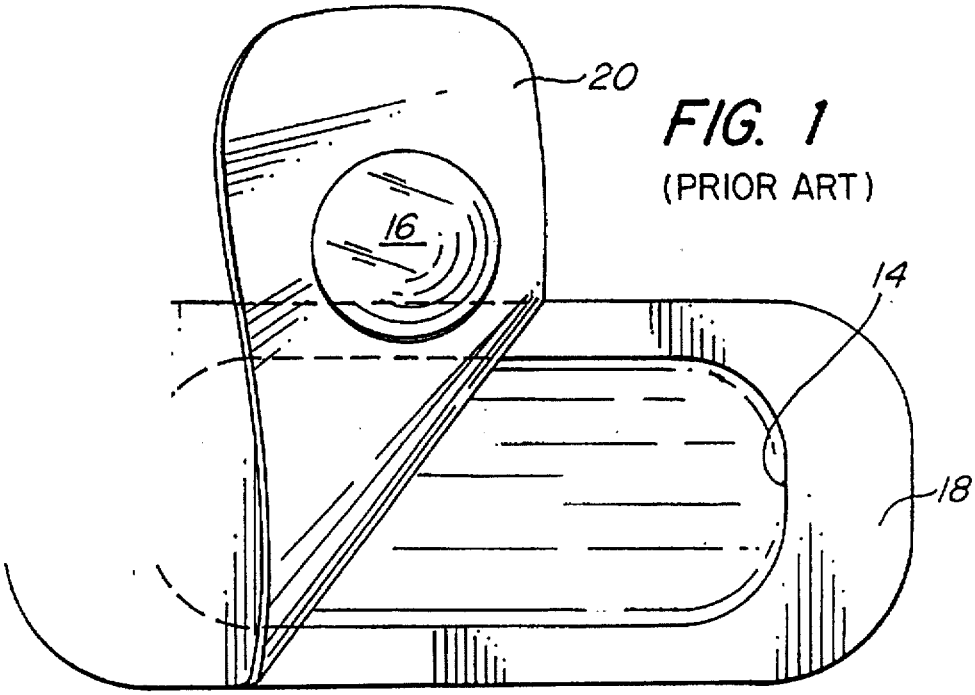
FIG. 1 (PRIOR ART)
FIG. 1 is a plan view of a prior art lens storage container with the closure partially removed.
Figure 2:
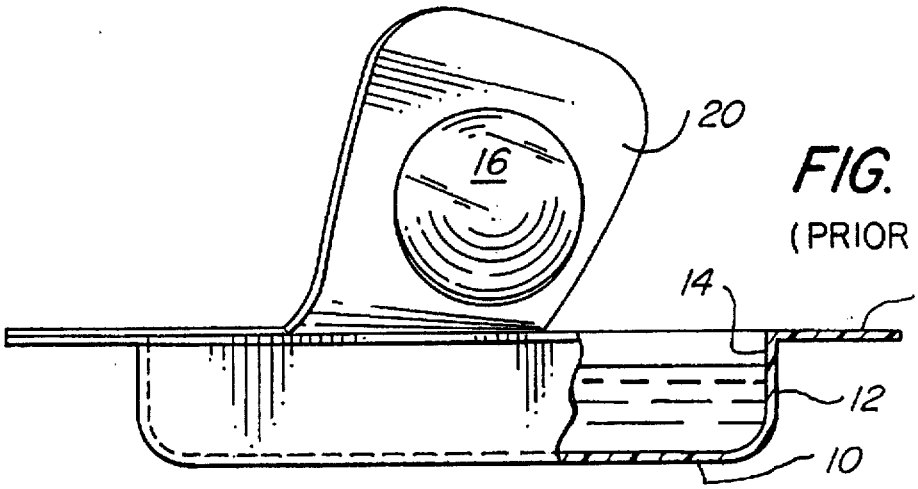
FIG. 2 (PRIOR ART)
FIG. 2 is a side elevational view thereof in partial section.
Figure 3:
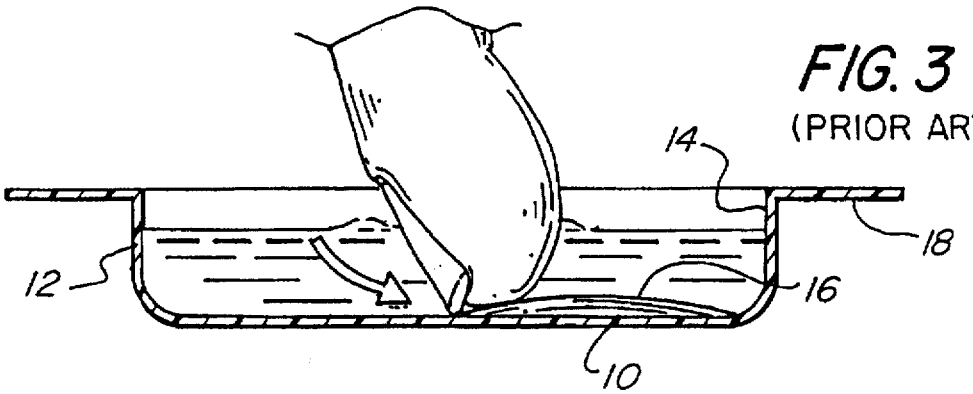
FIG. 3 (PRIOR ART)
FIG. 3 is a sectional view having the closure fully removed and a user's finger searching for the lens.

In FIGS. 1–3, there is illustrated a widely employed type of contact lens container which has a receptacle with a bottom wall 10 and a sidewall 12 extending upwardly from the periphery of the bottom wall 10. The bottom wall 10 and the sidewall 12 form a cavity 14 which holds the stored contact lens 16 and a saline solution to keep the lens moist during storage. An outwardly directed, generally planar flange 18 at the upper end of the sidewall 12 is sealingly engaged with a closure or a cover 20 which is typically a metallic foil or foil/plastic laminate adhered to the upper surface of the flange 18.

With this type of container, the lens 16 is frequently difficult to locate within the confines of the receptacle as it is free to move therein within the solution. Additionally, the lens 16 can adhere to the closure 20 or to the surface of the receptacle, and it can also fold over upon itself. This can result in damage from a fingernail or loss of the lens when the container is opened and lens removal is attempted.

Figure 4:
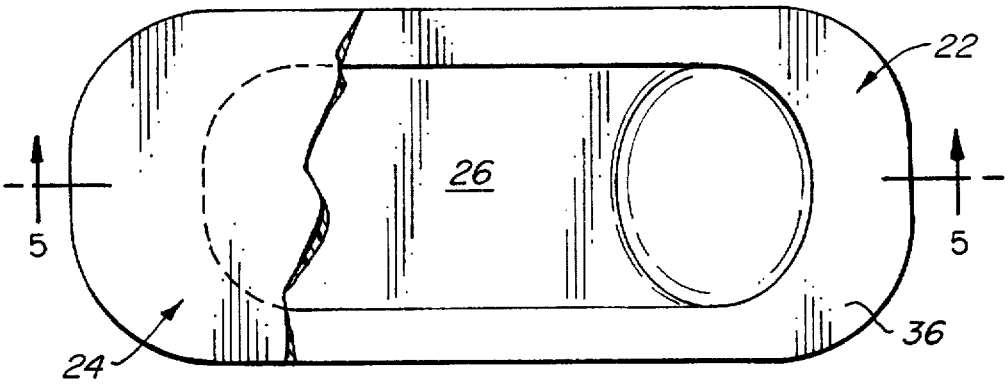
FIG. 4 is a plan view of a lens storage container embodying the present invention with the closure broken away and a lens positioned on the post.
Figure 5:
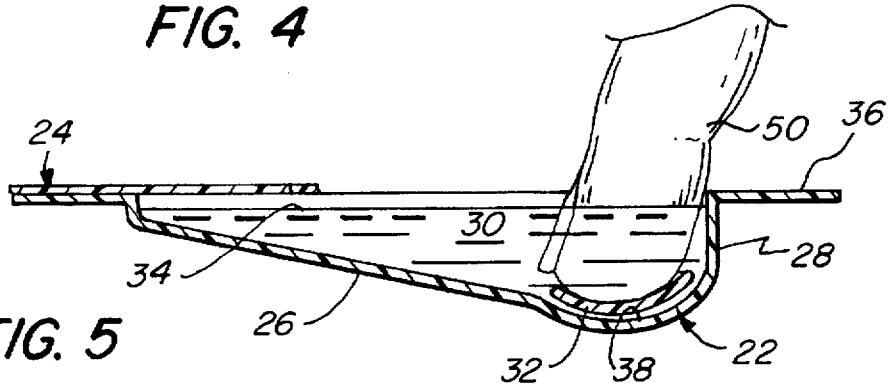
FIG. 5 is a sectional view thereof along the line 5—5 of FIG. 4.

Turning next to FIGS. 4 and 5, a lens storage container embodying the present invention is illustrated as comprising a receptacle generally designated by the numeral 22 and a closure 24. The receptacle 22 is of generally rectangular configuration and has a bottom wall 26 and sidewall 28 which extends upwardly from the periphery of the bottom wall 26 to provide a cavity 30 which opens at the upper end of the sidewall 28. This cavity 30 provides a compartment to contain the stored contact lens 32 and an appropriate wetting solution 34. An outwardly directed, generally planar flange 36 extends about the periphery of the upper end of the sidewall 28 and is sealingly engaged with the closure or cover 24 overlying the cavity 30.

The container is elongated so that the cavity 30 is substantially longer along the elongated axis than in the shorter axis.

The bottom wall 26 slopes downwardly along the elongated axis and at the deeper end adjacent the sidewall 28 is a concave recess generally designated by the numeral 38, which is of generally circular cross section. In this embodiment, the juncture of the recess 38 and the sidewall 28 is concavely arcuate, and the bottom wall 26 outwardly of the recess 38 lies in a common plane.

As seen in FIG. 5, the contact lens 32 seats in the concave recess 38 which has a similar radius of curvature. The cavity 30 contains a saline wetting solution 34 to keep the lens 32 saturated.

When the user desires to remove the lens 32, the closure 24 is peeled from the flange 36 and the user inserts a finger 50 into the cavity 30 and into the recess 38. Capillary action will cause the lens 32 to adhere to the fingertip and permit the user to remove it easily.

Figure 6:
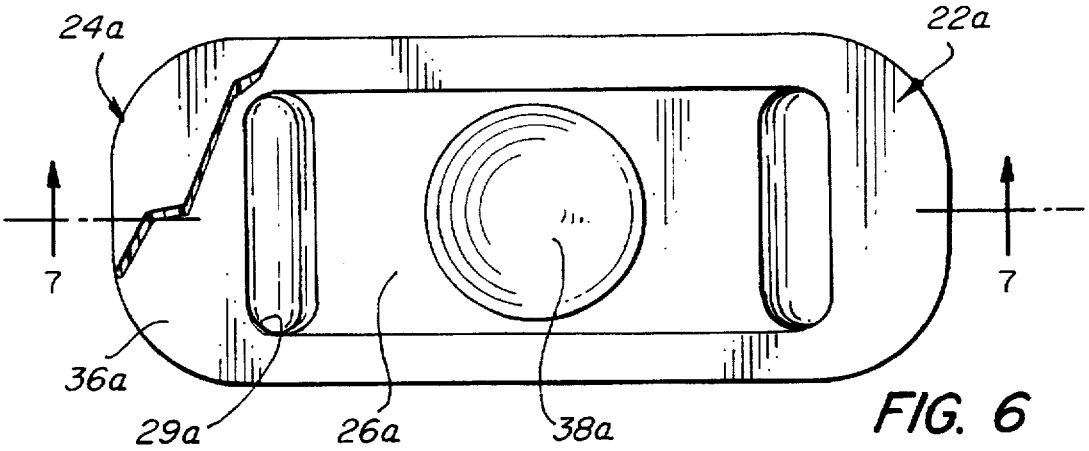
FIG. 6 is a plan view of another embodiment of a contact lens storage container embodying the present invention with the closure broken away.
Figure 7:
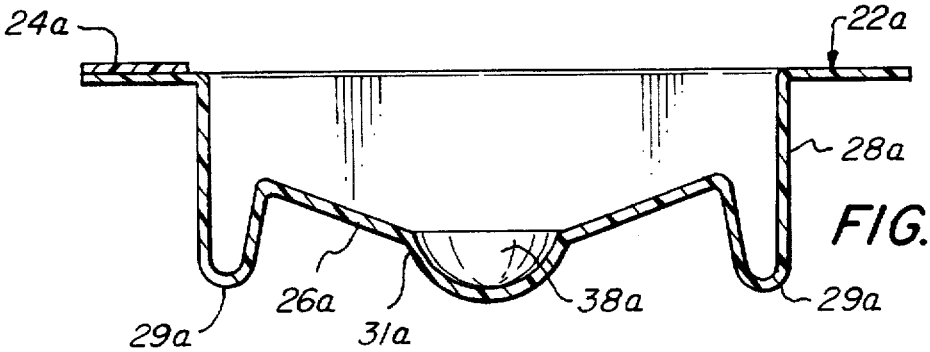
FIG. 7 is a sectional view thereof along the lines 7—7 of FIG. 6.

Turning next to FIGS. 6 and 7, the embodiment is one in which the bottom wall **26*a* of the receptacle 22*a* is initially inclined upwardly from the juncture with the sidewall 28 at the ends of the longer axis to provide foot portions 29*a* at the ends for stable seating of the container on a table or the like. The bottom wall 28*a* then slopes downwardly from the foot portions 29*a* to a centrally disposed portion 31*a* which is of arcuate cross section to provide the recess 38*a* and which has its portion outer surface in the same plane as the foot portion 29*a***.

Figure 8:
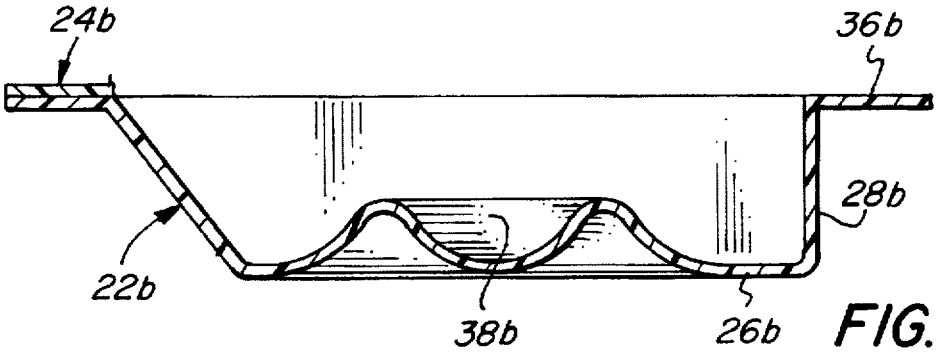
FIG. 8 is a sectional view of another embodiment of a contact lens storage container embodying the present invention.

In FIG. 8, the embodiment is one in which the bottom wall **26*b* of the receptacle 22*b* is planar adjacent the ends along its elongated axis. The bottom wall 26*b* extends upwardly and then downwardly to provide a concavely arcuate recess 38*b*** intermediate its length.

Figure 9:
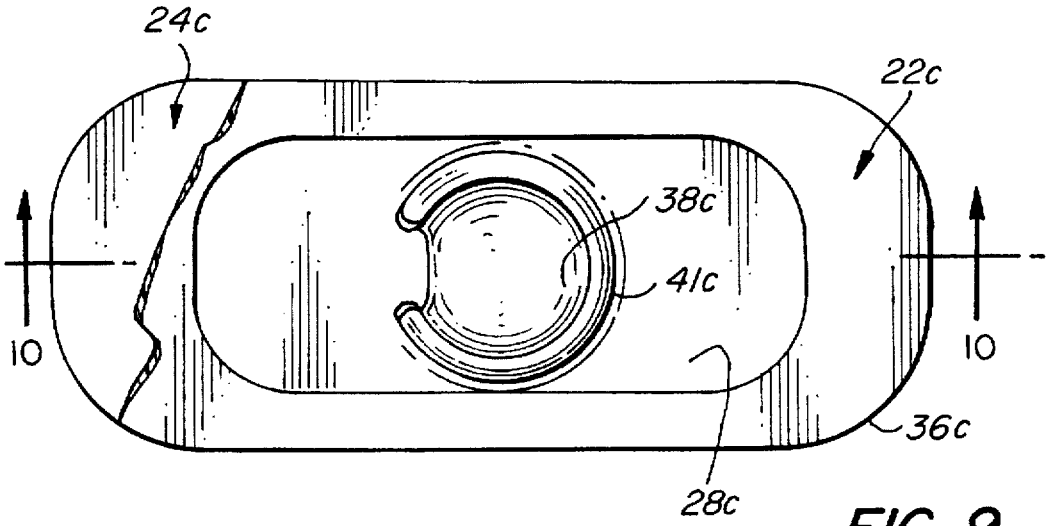
FIG. 9 is a plan view of another embodiment of a contact lens storage container embodying the present invention with the closure broken away.
Figure 10:
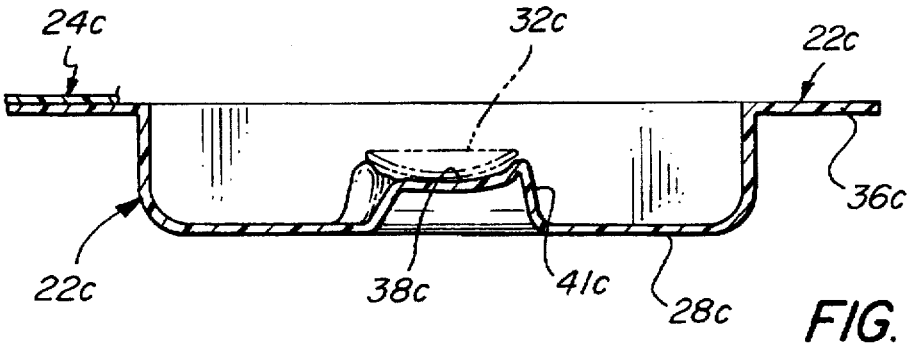
FIG. 10 is a sectional view thereof along the lines 10—10 of FIG. 9.

Turning next to FIGS. 9 and 10, this embodiment has the bottom wall **28*c* extending in a plane except at its center in which it tapers upwardly to provide a pedestal portion 41*c* in the upper surface of which is the concave recess 38*c***.

In the embodiment of FIGS. 4 and 5, the soft lens can be physically placed in the concave recess at the time of manufacture, or the lens manufacturer may elect to just place the lens in the storage case without any attempt to position the lens against the concave recess. If the economics of production dictate that the cost to physically place the lens in the concave recess with specific regard to lens orientation is too high, then the latter method may be used. The sloped portion of the storage case will act as a wave guide and tend to cause the soft lens to gravitate to the well area even if the lens is just put in the storage case without any effort being made as to proper placement. Due to gravitation and the wave guide effect of the sloped floor, a lens placed anywhere in the storage case will tend to settle in the concave area over time. Once settled in this area, such a lens will adhere to the concave surface.

The radius of curvature of the recess should approximate the radius of curvature of the human cornea or about 5.7 to 11.7 millimeters, and preferably about 8.7 millimeters.

In using the storage container of the present invention, the manufacturer of the soft contact lens places the lens in the concave recess. Because the radius of curvature of the recess is similar to that of the cornea of a human eye, the lens adheres to its surface by means of capillary attraction, which keeps a lens against the human cornea when the lens is placed in the eye. Just as sudden head movements will not displace a lens placed in the eye, shaking or striking the lens storage container will typically not dislodge the lens seated in the recess. Should it be dislodged, wave action will generally cause it to return to the recess and seat therein due to the capillary action.

It does not make a significant difference whether the lens is mounted right side out or inside out. Since the lens is typically made from a very thin membrane, the lens will readily deform and adhere securely in either orientation. The orientation selected will usually depend upon the manufacturing process employed, and the user of the lens can be advised of the chosen orientation to allow for proper orientation of the lens in the eye.

The receptacle of lens storage container of the various embodiments is readily formed from synthetic resin by injection molding although thermoforming and compression molding may also be employed. Various resins may be employed including polyethylene and polypropylene which are relatively economical.

The closure or cover may be a metallic foil using an adhesive or a foil with a laminated layer or coating of resin which enables heat sealing to provide a suitable bond to the flange.

Thus, it can be seen from the foregoing detailed specification and attached drawings that the disposable lens storage container of the present invention provides convenient location of the lens and facilitates removal of the lens from the container to minimize the potential for damage to the lens during removal. The container may be fabricated readily and economically.

Having thus described the invention, what is claimed is:

1. A disposable contact lens storage container for a single lens comprising:

(a) an elongated receptacle member integrally formed of synthetic resin and having (i) a bottom wall with upper and lower surfaces;

(ii) a sidewall extending upwardly from the periphery of said bottom wall and cooperating therewith to provide a single cavity opening at the upper end of said sidewall, said bottom wall having a portion extending upwardly from the plane of its juncture with said sidewall to provide a single pedestal with a concavely curved recess on the upper surface thereof configured and dimensioned to seat a contact lens therein, the radius of curvature of said concave recess being about 5.7 to 11.7 millimeters, said bottom wall outwardly of said pedestal lying in a common plane, and the juncture of said pedestal portion and the portion of said bottom wall thereabout being generally concavely arcuate; and (iii) an outwardly extending flange at the upper end of said sidewall; and (b) a planar closure extending across said cavity and releasably adhered to said flange on said sidewall of said receptacle member.

2. The contact lens storage container in accordance with claim 1 wherein said receptacle member is elongated and said pedestal portion is spaced from the sidewall at the ends of the elongated axis.

3. The contact lens storage container in accordance with claim 1 wherein said receptacle member is generally rectangular.

4. A disposable contact lens storage container for a single lens comprising:

(a) an elongated receptacle member of generally rectangular configuration and integrally molded of synthetic resin and having (i) a bottom wall with upper and lower surfaces;

(ii) a sidewall extending upwardly from the periphery of said bottom wall and cooperating therewith to provide a single cavity opening at the upper end of said sidewall, said bottom wall having a portion extending upwardly from the plane of its juncture with said sidewall to provide a single pedestal with a concavely curved recess on the upper surface thereof configured and dimensioned to seat a contact lens therein, the radius of curvature of said concave recess being about 5.7 to 11.7 millimeters, said bottom wall outwardly of said pedestal lying in a common place and the juncture of said pedestal portion and the portion of said bottom wall thereabout being generally concavely arcuate, said pedestal portion being spaced from the sidewall at the ends of the elongated axis of said receptacle member; and (iii) an outwardly extending flange at the upper end of said sidewall; and (b) a planar closure extending across said cavity and releasably adhered to said flange at the upper end of said sidewall of said receptacle member.

5. The contact lens storage container in accordance with claim 4 wherein said pedestal portion is spaced from the sidewall at the ends of the elongated axis.

* * * * *